United States Patent [19]

Nishizawa et al.

[11] Patent Number: 4,951,634

[45] Date of Patent: Aug. 28, 1990

[54] FUEL INJECTION DEVICE FOR AN INTERNAL COMBUSTION ENGINE

[75] Inventors: Hiroyuki Nishizawa, Kyoto; Kimito Kashiwabara, Kameoka; Osamu Nako, Okazaki; Mitsuaki Ishii, Himeji; Kouichi Yamane, Himeji; Masaaki Miyazaki, Himeji; Ryoji Nishiyama, Amagasaki, all of Japan

[73] Assignees: Mitsubishi Jidosha Kogyo Kabushiki Kaisha; Mitsubishi Denki Kabushiki Kaisha, both of Tokyo, Japan

[21] Appl. No.: 368,631

[22] Filed: Jun. 20, 1989

[30] Foreign Application Priority Data

Jun. 20, 1988 [JP] Japan ..... 63-151604

[51] Int. Cl.[5] ..... F02B 3/00

[52] U.S. Cl. ..... 123/492; 123/494

[58] Field of Search ..... 123/492, 493, 478, 480, 123/486, 488, 489; 364/431.07

[56] References Cited

U.S. PATENT DOCUMENTS

| | | | |
|---|---|---|---|
| 4,787,358 | 11/1988 | Kasanami et al. | 123/492 |
| 4,817,572 | 4/1989 | Nakisawa et al. | 123/492 |
| 4,841,939 | 6/1989 | Sakamoto et al. | 123/494 |
| 4,844,042 | 7/1989 | Osano | 123/488 X |
| 4,858,581 | 8/1989 | Hosoi et al. | 123/489 |
| 4,862,369 | 8/1989 | Yakawa et al. | 364/431.07 |
| 4,864,999 | 9/1989 | Fujisawa | 123/493 X |

*Primary Examiner*—Raymond A. Nelli
*Attorney, Agent, or Firm*—Sughrue, Mion, Zinn, Macpeak and Seas

[57] ABSTRACT

A fuel injector for a spark ignition internal combustion engine is disclosed, wherein the amount of injected fuel is increased by an extra amount when the engine is in a transient accelerating state. The air pressure within the air inlet passage to the engine is detected by an air pressure sensor, and the load condition is judged by comparing the detected pressure with a reference level. Further, the variation or increment of the detected pressure over each fuel injection period is calculated and compared with a high or a low threshold level selected in accordance with the load condition of the engine. Preferably, the high threshold level is selected when the high load condition continues over a predetermined length of time, the low threshold level being otherwise selected. The amount of transient extra increase is determined in accordance with the result of the comparison of the pressure variation with the selectd threshold level. On the other hand, the fundamental amount of injected fuel is calculated on the basis of an instantaneous current air pressure when the above amount of transient extra increase is not zero; otherwise, on the basis of an average of the pressure over the fuel injection period. The sum of the fundamental amount and the transient increase is injected in synchrony with every predetermined number pulse of the crank angle signal.

11 Claims, 11 Drawing Sheets

FIG. 2
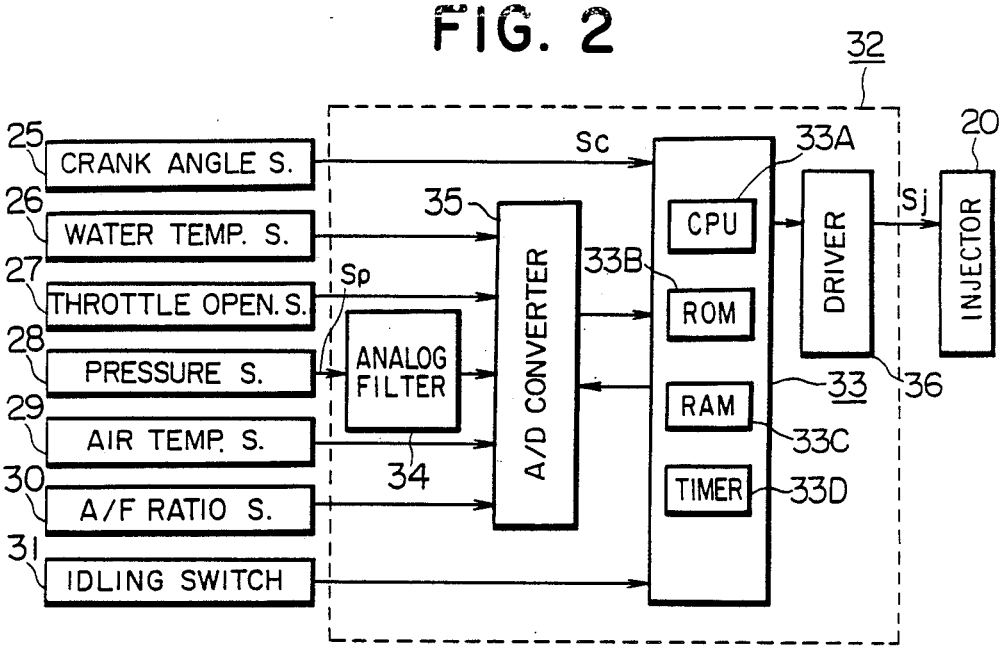
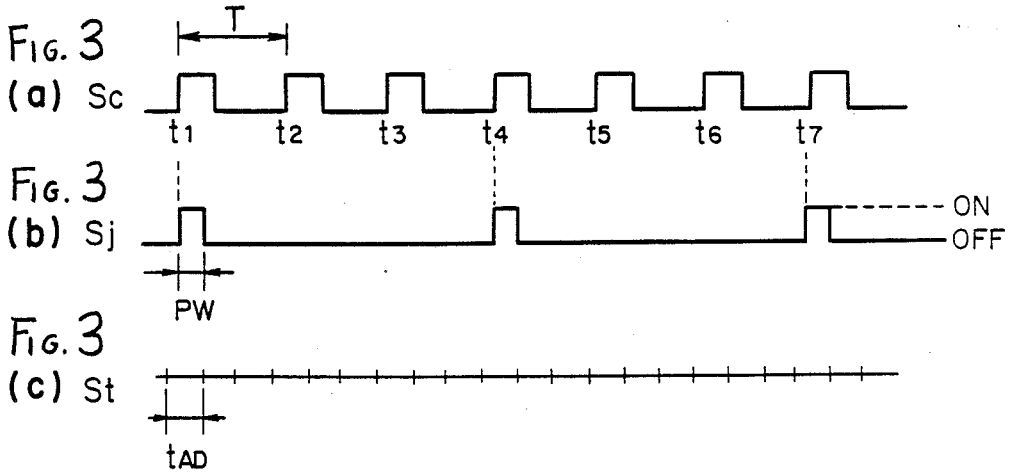

FUEL INJECTION DEVICE FOR AN INTERNAL COMBUSTION ENGINE

BACKGROUND OF THE INVENTION

This invention relates to fuel injection devices for spark ignition type internal combustion engines, and more particularly to control devices for controlling the amount of fuel that is to be injected into the air inlet passage to the cylinders of internal combustion engines.

Conventionally, the supply of fuel to the spark ignition type internal combustion engines of passenger automobiles has been effected by carburetors; recently, however, fuel injectors are becoming increasingly common. These fuel injectors are capable of supplying a precisely controlled amount of fuel to the internal combustion engine so as to obtain an optimum air-fuel ratio. In the case of the conventional fuel injectors, the amount of fuel injected into the air inlet passage to the cylinders of an engine is determined as follows:

The air pressure within the air intake passage to the engine is detected by an air pressure sensor, and converted into an air pressure data; then, the variation of the air pressure data is compared with a predetermined threshold level to determine whether the engine is in the transient state or not; further, in accordance with the result of this determination, the amount of fuel to be injected is calculated on the basis of the above pressure data. An amount of fuel corresponding to this calculated amount is injected in synchrony with a predetermined crank angle of the engine.

The conventional fuel injectors therefore has the following disadvantages: When the load of the engine is high, the ripples contained in the pressure data (i.e., the small fluctuations resulting from pulsations of the air current in the air inlet passage to the engine) become consipicuous. Thus, erroneous detections of a transient state of the engine tend to occur due to these ripples; if this is to be avoided, the threshold level with which the variation of the pressure data is compared must be set at a relatively high value. The high threshold value, however, results in the lower sensitivity of transience detection; thus, the detection of transience of the engine is retarded when the engine is under the low load condition, and, consequently, the adaptation of the injected amount of fuel to the rapidly changing condition of the engine is belated. As a result, the air-fuel ratio is deviated from the optimum level, and the performance of the engine is impaired.

If, on the other hand, the threshold level with which the variation of the pressure data is compared is set at a relatively low value, the sensitivity of transience detection is improved; however, erroneous detections of transience tend to occur, which result in an abonormally rich air-fuel mixture. Consequently, the driving performance is impaired and the cost of fuel is increased.

SUMMARY OF THE INVENTION

The primary object of this invention is therefore to provide a fuel injection device for an internal combustion engine which is quick in its response to the transient states of the engine, and in which the air-fuel ratio can be maintained always at the optimum level; more specifically the object of this invention is to provide such a fuel injection device which is not adversely affected by the ripples contained in the pressure data of the air inlet passage to the engine.

The above object of this invention are accomplished in accordance with the principle of this invention in a fuel injection device for an internal combustion engine comprising, in addition to a fuel injector for injecting a controlled amount of fuel into the air inlet passage to the cylinders of the engine, the following: (A) a pressure detector for detecting the air pressure within the air inlet passage to the engine; (B) a portion for determining the transient extra increase of the amount of fuel; (C) a portion for determining the fundamental amount of fuel; and (D) an adder for adding the transient increase and the fundamental amount determined by the above portions (B) and (C), respectively, to obtain the total amount of fuel that is to be injected by the fuel injector.

The above portion (B) which is characteristic of this invention comprises: pressure variation determining means, coupled to the pressure detector, for determining a variation of the pressure data over a length of time; load condition judgement means for determining a load condition of the internal combustion engine; threshold level selecting means, coupled to the load condition judgement means, for selecting, in accordance with the load condition of the internal combustion engine determined by the load condition judgement means, a threshold level of the pressure variation determined by the pressure variation determining means; comparator means for comparing the pressure variation determined by the pressure variation determining means, with the threshold level selected by the threshold level selecting means; and transient increase calculation means, coupled to the comparator means, for calculating a transient increase of an amount of fuel that is to be injected by the fuel injection device, in accordance with the result of the comparision effected by the comparator means.

On the other hand, the above portion (C) which is also characteristic of this invention comprises: averaging means for taking an average of a plurality of pressure data outputted from said pressure detector means over an interval of time; pressure data selector means, coupled to the pressure detector means, averaging means, and the transient increase calculation means, for selecting, in accordance with the transient increase of the amount of fuel calculated by the transient increase claculation means, either the averaged pressure data determined by the averaging means or the pressure data currently outputted from the pressure detector means; and fundamental amount calculating means, coupled to the pressure data selecting means, for calculating a fundamental amount of fuel that is to be injected by the fuel injection device, wherein the calculation of the fundamental amount of injected fuel is based on a pressure value selected by the pressure data selector means.

Thus, according to this invention, the threshold level with which the variation of the pressure data is compared is selected in accordance with the load condition of the engine; as a result, the determination of the transient increase by the portion (B) does not suffer from adverse effects of the ripples contained in the pressure data, while it is quickly adjusted to the transient state of the engine. In addition, the portion (C) selects either an averaged or a current pressure data in accordance with the value of the transient increase determined by the portion (B), and the calculation of the fundamental amount of fuel is effected on the basis of the selected pressure value (i.e. the averaged or current pressure data); as a result, the determination by the portion (C) of the fundamental amount of injected fuel also does not suffer from adverse effects of the ripples contained in the pressure data, while it is quickly adjusted to the transient state of the engine. Consequently, the total amount of the injected fuel calculated by the adder is such that the air-fuel ratio can be maintained always at the optimum level irrespective of the operating state of the associated engine.

BRIEF DESCRIPTION OF THE DRAWINGS

The novel features which are believed to be characteristic of this invention are set forth with particularity in the appended claims. This invention itself, however, both as to its organization and method of operation, together with further objects and advantages thereof, may best be understood from the following detailed description of the preferred embodiments, taken in conjunction with the accompanying drawings, in which:

FIG. 2 is a block diagram showing the organization of the electronic control unit for controlling the operation of the engine of FIG. 1;

FIG. 3 (*a*, *b*, and *c*) is a diagram showing the waveforms of the signals generated in the control device of FIGS. 1 and 2;

FIGS. 5 through 7A and 7B are flowcharts showing an example of the steps followed by the fuel injection control device according to this invention;

In the drawings, like reference numerals represent like or corresponding portions or steps.

DETAILED DESCRIPTION OF THE PREFERRED EMBODIMENTS

Referring now to the accompanying drawings, the preferred embodiments of this invention are described.

Figure 1:
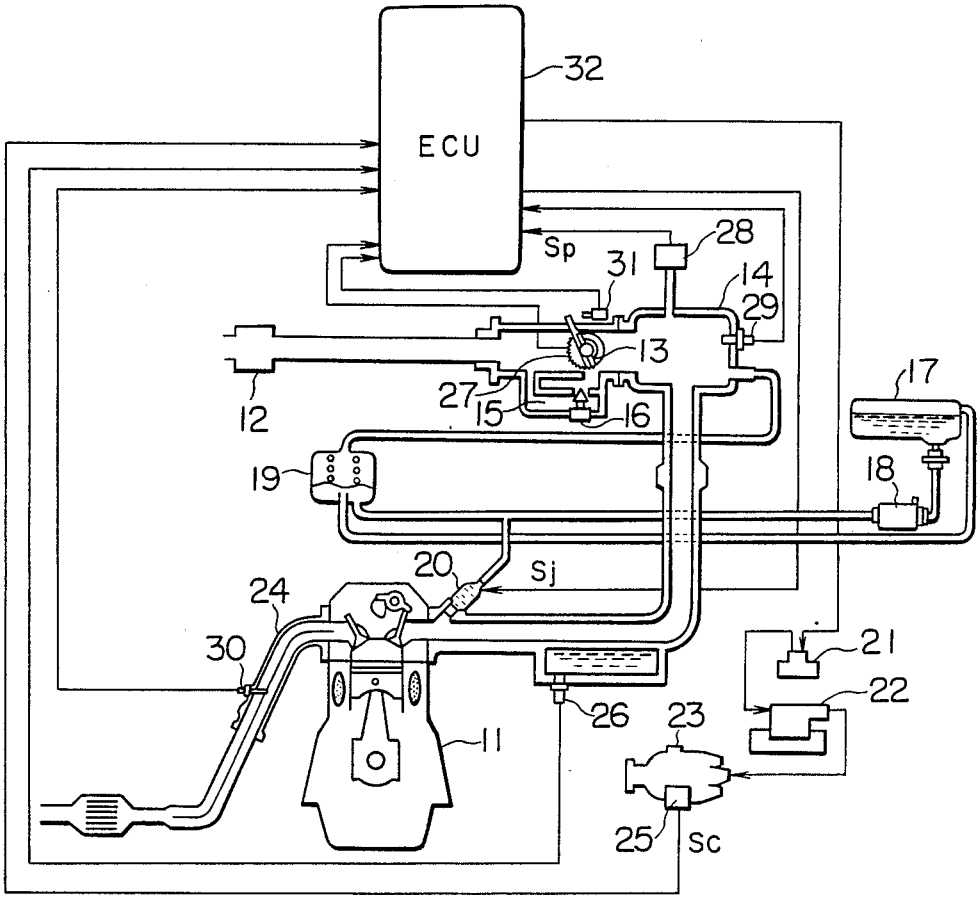
FIG. 1 is a diagramatic view of an internal combustion engine provided with a fuel injection device according to this invention.

FIG. 1 shows the overall organization of a spark ignition type internal combustion engine provided with a fuel injector and an electronic control unit according to the present invention; the following description is made of the case where the engine 11 is a four-cycle three-cylinder engine. When the engine 11 is driven, the air for the combustion is taken into the cylinders of the engine 11 through an air cleaner 12, a throttle valve 13, and a surge tank 14 in this order. During the idling period, however, the throttle valve 13 is closed, and the air for combustion is introduced into the cylinders of the engine 11 via the bypass passage 15 bypassing the throttle valve 13, wherein the opening of the bypass passage 15 is controlled by a thermowax type fast idling valve 16. On the other hand, the fuel (i.e. gasoline) is supplied from the fuel tank 17 by means of a fuel pump 18 through a fuel pressure regulator 19 to fuel injectors 20 disposed in each air intake pipe supplying the air-fuel mixture to the respective cylinders of the engine 11.

Further, the ignition signals are supplied from an ignition driving circuit 21, through an ignition coil 22 and a distributor 23 in this order, to ignition plugs (not shown) disposed in each cylinder of the engine 11. The exhaust gas produced by the combustion in the cylinders of the engine 11 is exhausted into the atmosphere through the exhaust manifold 24, etc.

On the other hand, the sensor system of the engine 11 has the following organization: A crank angle sensor 25 mounted on the distributor 23 detects the numbers of revolutions per minute (rpm) of the crank shaft of the engine 11, and outputs a pulse-shaped crank angle signal Sc whose frequency corresponds to the number of rpm; for example, the crank angle sensor 25 outputs a crank angle signal Sc whose pulses rise at 70 degrees BTDC (before top dead center) and decay at TDC (top dead center). Thus, the crank angle signal Sc has the waveform as shown in FIG. 3 (*a*), whose period T between the leading edges (shown at $t_1$ through $t_7$ in the figure) of two adjacent pulses varies inversely proportionally to the number of rpm Ne of the engine 11. Further, a temperature sensor 26 detects the temperature of the coolant water of the engine 11; an opening degree sensor 27 detects the opening of the throttle valve 27; a pressure sensor 28 disposed in the surge tank 14 detects the absolute pressure within the air inlet passage to the engine 11 and outputs a corresponding pressure signal Sp; an intake air temperature sensor 29 dispased at the surge tank 14 detects the intake air temperature; an air/fuel ratio sensor 30 disposed in the exhaust manifold 24 detects the concentration of the oxygen in the exhaust gas from which the air/fuel ratio is determined; and an idling switch 31 outputs a signal when the throttle valve 13 is closed during an idling period. The signals thus outputted from the above sensors 25 through 30 and the switch 31 are supplied to an electronic control unit (ECU) 32; in response thereto, the electronic control unit 32 determines the amount of fuel to be injected from the injectors 20 according to the principle of this invention, as described below, and outputs an injector driving signal Sj to the fuel injectors 20 by which it controls, in accordance with the determined amount of fuel that is to be injected, the length of time during which the valves of the injectors 20 are to be opened. Further, the electronic control unit 32 controls the operation of the ignition driving circuit 21 in a manner well known to those skilled in the art.

FIG. 2 shows the interior organization of the electronic control unit 32 from the view point of the physical implementation thereof. (The functional organization of the control unit 32, especially that of the microcomputer 33, will be described later in reference to FIG. 4.) As shown in the figure, the control unit 32 comprises a microcomputer 33, an analong filter circuit 34, an A/D converter 35, and a driver circuit 36. The microcomputer 33, which effects various operations and judgements (described hereinbelow in reference to FIG. 4 and FIGS. 5 through 13) according to this invention comprises: a CPU (central processing unit) 33A for executing such operations and judgements; a ROM (read-only memory) 33B for storing the programs, etc., of such operations and judgements, which programs are illustrated, for example, in FIGS. 5 through 7; a RAM (random access memory) 33C functioning as a working memory for storing data detected by the sensors, etc.; and a timer 33D in which the length of time during which the valves of the injectors 20 are to be opened are set in each fuel injection cycle. The input ports of the microcomputer 33 are coupled to the outputs of the crank angle sensor 25, the idling switch 31, and the A/D converter 35, while the output ports thereof are coupled to the driver circuit 36 and, for the purpose of outputting reference signals, to the A/D converter 35.

The analog filter circuit 34 having an input coupled to the output of the pressure sensor 28 comprises a low pass filter that reduces the ripple contained in the pressure signal Sp outputted from the sensor 28.

The A/D converter 35 converts into corresponding digital signals the analog signal outputted from the filter circuit 34 and the analog detection signals outputted from the coolant water temperature sensor 26, the throttle opening degree sensor 27, the intake air temperature sensor 29 and the air/fuel ratio sensor 30. The A/D conversion of the output of the filter circuit 34 is effected at a predetermined fixed interval $t_{AD}$ (e.g. 2.5 milliseconds), as represented by the A/D conversion timing signal St shown in FIG. 3 (*c*).

On the other hand, the driver circuit 36 outputs, in response to the injection control signal outputted from the microcomputer 33, a pulse-shaped injector driving signal Sj. As shown in FIG. 3 (*b*), the injector driving signal Sj consists of a pulse train whose pulse width PW corresponds to the length of time during which the valves of the injectors 20 are to be opened; since the engine 11 comprises three cylinders, pulses of the signal Sj are generated in synchrony with every third pulse of the crank angle signal Sc. Thus, in response to the injector driving signal Sj, the injectors 20 inject controlled amounts of fuel, in the intervals PW beginning at instants $t_1$, $t_4$, and $t_7$ respectively in the figure, simultaneously for all the three cylinders of the engine 11.

Figure 4:
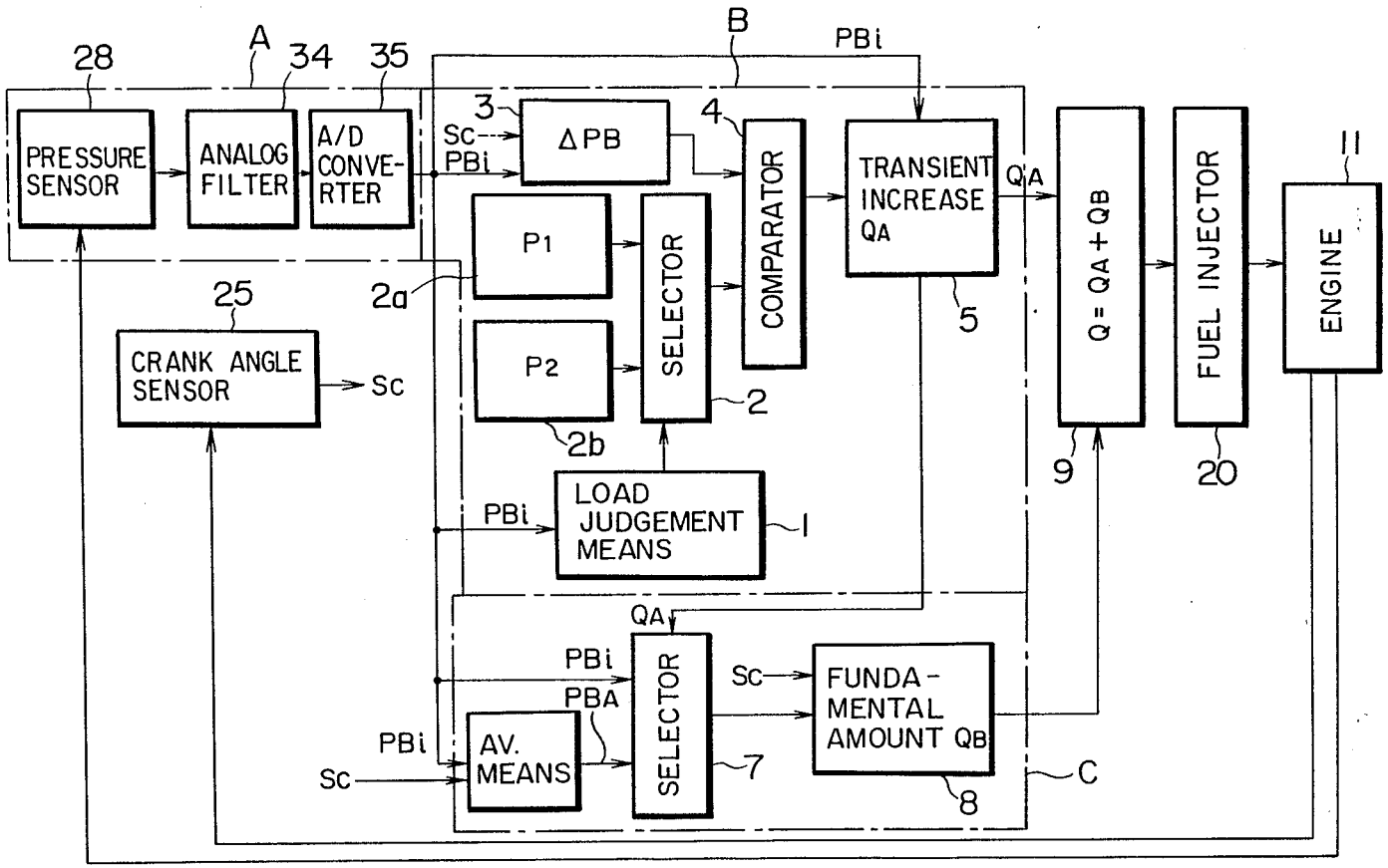
FIG. 4 is a block diagram showing the functional organization of the control device for controlling the amount of injected fuel according to the principle of this invention.

Let us now describe the principle of this invention in reference to FIG. 4, which shows schematically the organization of microcomputer 33 from the functional point of view, in combination with the organizations of the elements associated therewith. As shown in the figure, the device according to this invention comprises, among others, three main portions A through C: portion A for obtaining a pressure data PBi corresponding to the air pressure within the air inlet passage to the engine 11; portion B for determining the transient increase $Q_A$ in the amount of the fuel that may become necessary due to the transient state, e.g. a rapid acceleration of the engine 11; and portion C for determining the fundamental amount $Q_B$ of the fuel that is to be injected. In addition, the device according to this invention comprises the crank angle sensor 25, an injection fuel determining means or an adder 9 for computing the sum of the outputs of the portions B and C (i.e., the actual amount of fuel that is to be injected), and the fuel injector 20 for injecting the amount of fuel determined by the adder 9 into the air inlet to the engine 11. (It is noted that the engine 11 and the fuel injector 20 as represented schematically in FIG. 4 comprise more portions than in the case of FIGS. 1 and 2.)

The portion A for obtaining the pressure data PBi comprises the pressure sensor 22, the analog filter circuit 34, and the A/D converter 35. The pressure sensor 22 outputs the pressure signal Sp corresponding to the pressure within the air intake passage to the engine 11; the analog filter 34 reduces the ripples contained in the pressure signal Sp; and the A/D converter 35 converts the output of the filter circuit 34 into a corresponding digital signal, i.e. the pressure data PBi.

The portion B comprises: a load condition judgement means 1 for determining the condition of the load of the engine 11; a selector or change-over means 2 for selecting or changing over between the first and second threshold values $P_1$ and $P_2$ outputted from the first and second threshold value output means 2*a* and 2*b*, respectively, wherein the selection is made in response to the output of the load condition judgement means 1; a variation detector means 3 for determining the variation (i.e. increment or decrement) ΔPBi of the pressure data PBi; a comparator means 4 for comparing the variation ΔPBi with the threshold level selected by the selector means 2; and a means for calculating the transient increase $Q_A$ of the amount of fuel which is to be added, to obtain the actual amount of fuel Q, to the fundamental amount of fuel $Q_B$ outputted from the portion C described below.

The method of operation of the means 1 through 5 of the portion B is as follows:

The load condition judgement means 1 determines the condition of the load of the engine 11 on the basis, for example, of the pressure data PBi corresponding to the output Sp of the pressure sensor 28; namely, it determines, for example, whether the current pressure data PBin, which corresponds to the current condition of the load of the engine 11, is above a predetermined level $P_0$ or not. Thus, if PBin is not less than $P_0$, the means 1 judges that the engine 11 is under the high load condition; if, on the other hand, PBin is less than $P_0$, the means 1 judges that the engine 11 is under the low load condition. The above fundamental method of operation of the means 1 corresponds to step 307 in the flowchart of FIG. 7 described below. In a more preferred form shown in the flowchart of FIG. 8 (*a*) (the steps 307, 307A, 307B, and 307C), which is described in detail below, the load condition judgement means 1 determines the load condition of the engine 11 in the following manner: When the condition: $PBin \geqq P_0$ holds for a predetermined number of occurences of the pulses of the crank angle signal Sc or more, the means 1 judges that the high load condition requires the usage of the higher threshold level in the comparison effected by the comparator 4; otherwise, it judges that the load condition does not require the usage of the higher threshold level therein. This preferred method of operation characteristic of this invention ensures that the adverse effects of the ripples (i.e. small fuctuations resulting from pulsations of the air current in the air intake passage to the engine, which is more manifest under the high load condition of the engine 11) contained in the pressure signal Sp are eliminated by the means 1. Similarly, in another preferred form shown in the flowchart of FIGS. 9 and 10 (*a*) (the steps 307, 307E, 307F, and 307G of FIG. 10 (*a*), together with step 203A of FIG. 9), which is described in detail below, the means 1 judges that the load of the engine is high when the condition $PBin \geqq P_0$ holds for a predetermined length of time or more; otherwise, it judges that the load is low. Further, as described below in reference to FIG. 12, the means 1 may determine the load condition of the engine 11 on the basis of the opening degree of the throttle valve 13 detected by the sensor 27.

In accordance with the result of the judgement made by the load condition judgement means 1, the threshold level selector means 2 selects one of the two threshold levels: the low level (the first threshold level) $P_1$ outputted from means 2a, or the high level (second threshold level) $P_2$ outputted from means 2b. On the other hand, the variation determining means 3 determines the variation ΔPBi of the pressure data PBi, during each interval of time determined, for example, by the pulses of the crank angle signal Sc; more specifically, the variation determining means 3 may determine the variation ΔPBi by means of the following equation:

$$\Delta PBi = PBin - PBio,$$

wherein PBin is the value of the pressure data PBi detected just before the curent injection of fuel and PBio is the value of the pressure data PBi detected just before the immediately preceeding injection of fuel. Thus, the comparator 4 compares the pressure data variation ΔPBi with the threshold level (i.e. $P_1$ or $P_2$) selected by the selector 2 in accordance with the judgement of the load condition judgement means 1. Namely, the comparator 4 determines whether the condition holds or not:

$$\Delta PBi \geqq Pi,$$

wherein Pi is either $P_1$ or $P_2$ selected by the selector 2; when this condition holds, it may concluded that the engine 11 is in a transient state, e.g. a rapidly accelerating condition under which it needs a maximum amount of increase $Q_A$ of fuel; otherwise, that the engine is not in a rapid transience and hence the increase $Q_A$ may be decreased. Thus, in accordance with the result of the comparison effected by the comparator 4, the transient increase calculating means 5 calculates the transient increase $Q_A$ of the amount of fuel that is to be injected; more specifically, the increase calculating means 5 may determine the transient increase $Q_A$ in the following manner: When the variation ΔPBi is not less than Pi, i.e. $\Delta PBi \geqq Pi$ (namely, when the engine 11 is in a transient accelerating condition needing a maximum increase $Q_A$), the means 5 maximizes the transient increase $Q_A$. For example, the means 5 calculates a new candidate value $Q_{A\,1}$ of the transient increase $Q_A$ by multiplying the variation ΔPBi by a predetermined constant k:

$$Q_{A\,1} = k \cdot \Delta PBi;$$

further, the means 5 compares this candidate value $Q_{A\,1}$ with a previous value $Q_{A\,0}$ of the transient increase $Q_A$ stored in the RAM 33C shown in FIG. 2, and selects the larger one of the two values $Q_{A\,1}$ and $Q_{A\,0}$ as the new current value $Q_A$n of the transient increase $Q_A$, which is thereafter stored in the RAM 33C. On the other hand, when the variation ΔPBi is less than Pi, the means 5 obtains the new current value $Q_A$ n of the increase $Q_A$ by subtracting a predetermined value α from the previous value $Q_{A\,O}$, namely:

$$Q_{A\,n} = Q_{A\,O} - \alpha,$$

wherein the new current value $Q_A$ n is set to zero when the result of this subtraction becomes negative. The transient increase calculating means 5 outputs as the transient increase $Q_A$ the new current value $Q_A$ n which has been obtained as described above.

The portion C of FIG. 4, on the other hand, comprises: an averaging means 6 for taking an average $PB_A$ of the pressure data PBi; a selector means 7 for selecting either the averaged pressure data $PB_A$ or the current pressure data PBin in accordance with the output of the transient increase calculating means 5; and a fundamental amount calculating means 8 which calculates the fundamental amount $Q_B$ of the fuel, utilizing the averaged pressure data $PB_A$ or the current pressure data PBin selected by the selector means 7.

The operation of the portion C is as follows:

The averaging means 6 characteristic of this invention takes an average of the pressure data PBi over, for example, a predetermined interval of the crank angle signal Sc; more specifically, the averaging means 6 may take an average $PB_A$ of a number of successive pressure data PBi outputted from the A/D converter 35 between two successive fuel injections:

$$PB_A = \Sigma PBi/N,$$

wherein N is the number of the pressure data PBi outputted from the A/D converter 35 between two successive fuel injections, and Σ PBi is the sum of the N successive pressure data PBi. The selector 7 selects either the averaged pressure data $PB_A$ or the current pressure data PBin in response to the level of the output of the transient increase calculation means 5; more specifically, the selector 7 selects the averaged pressure data $PB_A$ when the transient increase $Q_A$ outputted from calculation means 5 is equal to zero; on the other hand, the selector 7 selects the current pressure data PBin when the transient increase $Q_A$ is greater than zero. The fundamental amount calculating means 8 calculates the fundamental amount $Q_B$ of the fuel in accordance with the selection made by the selector means 7. Namely, when the selector means 7 selects and outputs the averaged data $PB_A$, the fundamental amount calculation means 8 calculates the fundamental amount of fuel $Q_B$ by the following equation:

$$Q_B = K_Q \times K_A \times \eta_V(\mathrm{Ne},\ PB_A) \times PB_A,$$

wherein: $K_Q$ is the pressure-fuel conversion coefficient; $K_A$ is a composite correction factor which is a combination of correction factors determined by the factors such as the temperature of the coolant water detected by the water temperature sensor 26, the intake air temperature detected by the air temperature sensor 29, and the air/fuel ratio detected by the air/fuel ratio sensor 30; and $\eta_V$(Ne, $PB_A$) is the volumetric efficiency corresponding to the number of rpm, Ne, of the engine 11 and the averaged pressure data $PB_A$. On the other hand, when the selector 7 selects and outputs the current pressure data PBin, the calculation means 8 calculates the fundamental amount of fuel $Q_B$ by the following equation:

$$Q_B = K_Q \times K_A \times \eta_V(\mathrm{Ne},\ PBin) \times PBin.$$

To summarize the above operation, the calculation means 8 calculates the fundamental amount $Q_B$ on the basis of the averaged pressure data $PB_A$ when the engine 11 is not in a transient condition; otherwise, the means 8 calculates the fundamental amount $Q_B$ on the basis of the current instantaneous pressure data PBin. Thus, the determination of the fundamental amount $Q_B$ by the calculation means 8 is not adversely affected by the ripple in the pressure data; at the same time, it is capable of quickly responding to the change of the load condition of the engine 11.

The adder 9 determines the actual amount of fuel that is to be injected by the fuel injector 20 by taking the sum:

$$Q=Q_A+Q_B$$

of the transient increase $Q_A$ and the fundamental amount $Q_B$ of the fuel. In response to the output Q of the adder 9, the fuel injector means 20 measures and injects an amount of fuel corresponding to the amount Q into the air inlet passage to the engine 11.

Figure 5:
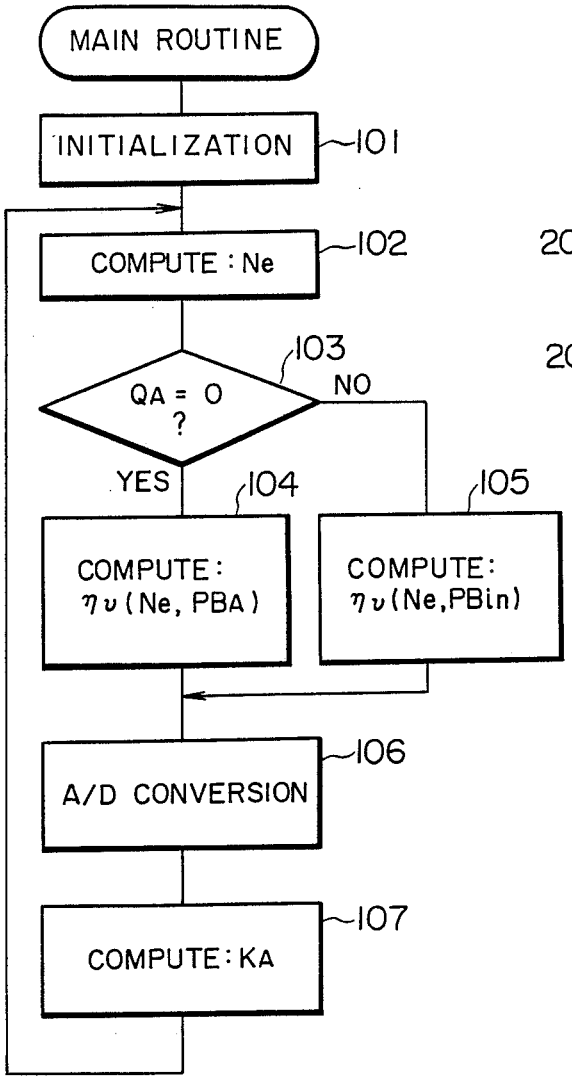
Figure 6:
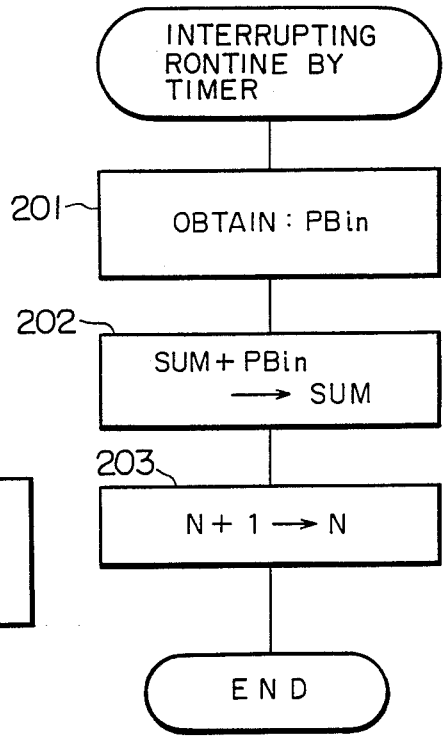
Figure 7:
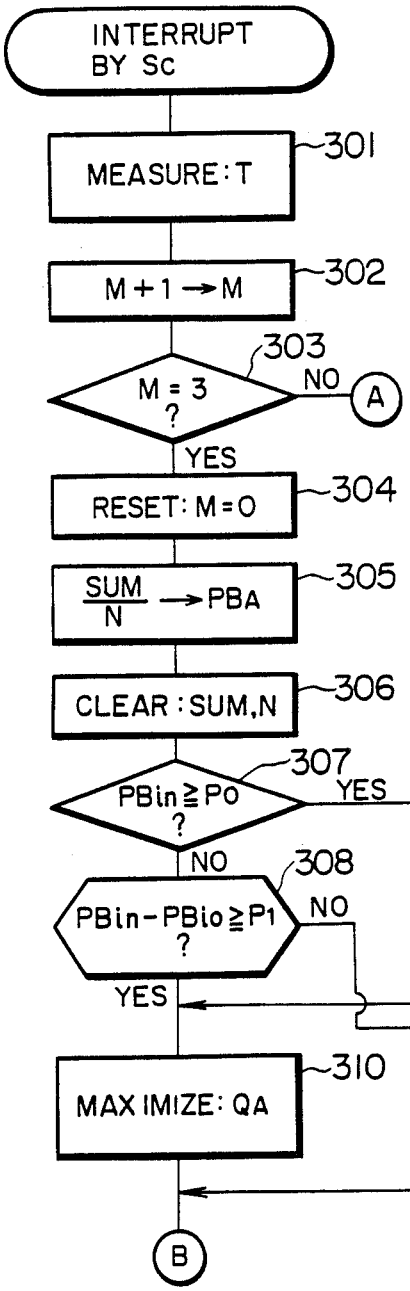
Figure 7:
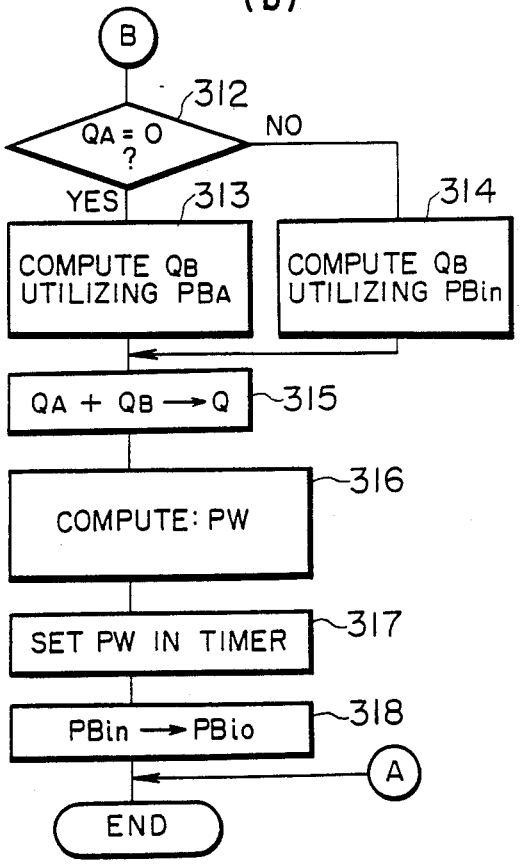

Referring now to FIGS. 5 through 7 of the drawings, let us describe the steps which are followed by the device according to the present invention shown in FIG. 4, whereby reference is also made to FIGS. 2 and 3.

FIG. 5 shows the main routine followed by the CPU 33A in determining the variables utilized in the calculation of the fundamental amount $Q_B$ of the injected fuel, etc. At step 101, the data stored in the RAM 33C are cleared to effect the initialization. At the next step 102, the measurement value of the period T of the crank angle signal Sc (refer to FIG. 3 (*a*)) is read out from the RAM 33C to determine the number of rpm, Ne, of the engine 11 by means of the operation: Ne=1/T; the number of rpm Ne thus obtained is stored in RAM 33C. At step 103, judgement is made whether the transient increase $Q_A$ (which is calculated and stored at steps 310 and 311 described hereinbelow in reference to FIG. 7) read out from the RAM 33C is equal to zero or not. If the judgement at step 103 is affirmative, the program proceeds to step 104, at which the number of rpm Ne and the averaged pressure data $PB_A$ are read out from the RAM 33C, so as to determine the volumetric efficiency $\eta_V$(Ne, $PB_A$) on the basis thereof. Namely, the values of volumetric efficiency for attaining a predetermined air-fuel ratio is stored in ROM 33B as a function (i.e. map) of the number of rpm and the pressure data, which function is determined beforehand by an experimental method; thus, the value of the volumetric efficiency $\eta_V$(Ne, $PB_A$) corresponding to the pair (Ne, $PB_A$) can be read out from the ROM 33C by the mapping method. The value of the volumetric efficiency thus determined is stored in RAM 33C. On the other hand, if the judgement at step 103 is in the negative, the number of rpm Ne and the current pressure data PBin are read out from RAM 33C to determine at step 105, by mapping in the ROM 33B, the value $\eta_V$(Ne, PBin) of the volumetric efficiency corresponding thereto, which value is stored in the RAM 33C. After the step 104 or 105 for determining the volumetric efficiency, the program proceeds to step 106 at which the following detection signals are subjected to A/D conversion via the A/D converter 35, to be stored in RAM 33C: the coolant water temperature signal outputted from the water temperature sensor 26; the throttle opening degree signal outputted from the opening degree sensor 27; the intake air temperature signal from the air temperature sensor 29, and the air/fuel ratio signal outputted from the air/fuel ratio sensor 30. Further, at step 107, the detection data relevant to the determination of the fundamental amount of injected fuel, i.e. the coolant water temperature data, the intake air temperature data, and the air/fuel ratio data, are read out from the RAM 33C, to determine the composite correction factor $K_A$ which is a combination of the correction factors such as: the warming up correction factor corresponding to the coolant water temperature; the intake air temperature correction factor corresponding to the temperature of the intake air; and the feedback correction factor determined on the basis of the air/fuel ratio feedback signal. After the step 107, the program returns to step 102 to repeat the above operations of the main routine.

FIG. 6 shows an interrupting routine for taking a sum of a number of successive pressure data which is used in calculating the averaged pressure data $PB_A$; at each end of the period $t_{AD}$ of the A/D conversion timing shown in FIG. 3 (*c*), an interrupt signal is generated to start this routine. At step 201, the output signal Sp of the pressure sensor 28 is, after being passed through the analog filter circuit 34, converted into a corresponding digital pressure data PBin by the A/D converter 35. At step 202, the new or current pressure data PBin is added to the accumulating sum of the pressure data SUM stored in the RAM 33C to obtain a new value of the accumulating sum of the pressure data SUM; this new accumulating sum, SUM, is stored in the RAM 33C together with the current pressure data PBin, so as to update the values thereof stored in the RAM 33C. At the final step 203 which concludes the subroutine of FIG. 6 initiated by a timer signal, unity (1) is added to the number, N, of the times the additions at step 202 which have been effected, so as to obtain an updated number N, which is then stored in the RAM 33C.

FIG. 7 shows an interrupting routine which is executed primariy for calculating the transient increase and fundamental amount of the injected fuel; each time a pulse of the crank angle signal Sc rises, a crank angle interrupt signal is generated to start this interrupting routine.

At step 301, the measurement value of the period T of the crank angle signal Sc is stored in the RAM 33C; this period T may be determined by a timer consisting of either a software or a hardware within the microcomputer 33. At step 302, unity (1) is added to the number of occurences, M, of the pulses of the crank angle signal Sc, to update the value of M. At step 303, judgment is made whether the number of occurences M of the pulses of the crank angle signal Sc is equal to 3 or not; if it has not yet reached 3, the current value of M is stored in the RAM 33C to end the routine of FIG. 7 at step 303. If, on the other hand, the judgement at step 303 is affirmative (i.e. M=3), the value of M stored in the RAM 33C is reset to zero (0) at the subsequent step 304, to proceed to step 305. Thus, the following steps 305 through 318 are performed at each third pulse of the crank angle signal Sc to effect a fuel injection.

At step 305, the average $PB_A$ of the pressure data PBin within a fuel injection period (which is equal to 3T as shown in FIG. 3 (*a*) and (*b*)) is obtained by deviding the accumulating sum of the pressure data SUM (which has been updated and stored in the RAM 33C at the immediately preceeding step 202) by the number of additions N (which has been updated and stored at the immediately preceeding step 203):

$$PB_A=SUM/N.$$

At the next step 306, the values of the sum of the pressure data SUM and the number of additions N stored in the RAM 33C are cleared to zero (0). At step 307, the current value of the pressure data PBin which has been obtained at the immediately preceeding step 201 (this current value PBin is the value of the pressure data that is obtained immediately before the current fuel injection, i.e. immediately before the leading edge of the pulse of the crank angle signal Sc that is synchronized with the current injection of fuel) is compared with a reference level $P_0$; if PBin is less than $P_0$, the program proceeds to step 308; on the other hand, if PBin is not less than $P_0$, it proceeds to step 309. At steps 308 and 309, the variation of the pressure data, i.e. the difference: $\Delta PBi = PBin - PBio$ is compared with a first (lower) threshold level $P_1$ and a second (higher) threshold levels $P_2$, respectively; wherein PBin is the current pressure data used at the above step 307 and PBio is the value of the pressure data that was obtained immediately before the preceeding fuel injection, i.e. immediately before the leading edge of the pulse of the crank angle signal Sc that was synchronized with the preceeding fuel injection. If the variation $\Delta PBi$ is not less than the respective threshold levels $P_1$ and $P_2$ at step 308 or 309:

$$\Delta PBi \geqq Pi,$$

wherein Pi represents the respective threshold levels $P_1$ and $P_2$ utilized in the comparison at steps 308 and 309, then, the transient increase $Q_A$ of the amount of injected fuel is maximized at step 310. More specifically, a candidate value $Q_{A\,1}$ of the transient increase is calculated by multiplying the variation $\Delta PBi$ by a constant k:

$$Q_{A\,1} = k \cdot \Delta PBi,$$

and this candidate value $Q_{A\,1}$ is compared with the previous value $Q_{A\,0}$ of the transient increase which is stored in the RAM 33C, so as to select the larger one of the two values $Q_{A\,1}$ and $Q_{A\,0}$ as the new maximized value $Q_A$ of the transient increase; this new maximized value of the transient increase $Q_A$ is stored in the RAM 33C. Incidentally, if preferred, the above candidate value $Q_{A\,1}$ may be used as the new (maximized) value of the transient increase $Q_A$ without comparing it with the previous value of the transient increase.

On the other hand, when the variation of the pressure data is less than the respective threshold levels at steps 308 and 809:

$$\Delta PBi < Pi,$$

wherein Pi represents the first threshold level $P_1$ at step 308 or the second threshold level $P_2$ at step 309, the transient increase $Q_A$ is decreased at step 311. Namely, the new decreased value of $Q_A$ is obtained by subtracting a predetermined constant $\alpha$ from the previous value of the transient increase, $Q_{A\,0}$, stored in the RAM 33C:

$$Q_A = Q_{A\,0} - \alpha;$$

when, however, the result of the above subtraction is negative, the new decreased value of $Q_A$ is clipped to zero. After the respective steps 310 and 311, the program proceeds to step 312.

At step 312, judgement is made whether the updated value of the transient increase $Q_A$ obtained at the preceeding step 310 or 311 is equal to zero or not, and the updated value of the transient increase $Q_A$ is stored in the RAM 33C immediately thereafter. If the judgement at step 312 is in the affirmative (i.e., $Q_A = 0$), the program proceeds to step 313, deciding that the engine 11 is not in the transient state; on the other hand, if the judgement at step 312 is in the negative, the program proceeds to step 314, deciding that the engine 11 is in the transient state. At step 313, the correction factor $K_A$, the volumetric efficiency $\eta v(Ne, PB_A)$, and the averaged pressure data $PB_A$ calculated at steps 107, 104, and 305 respectively, are read out from the RAM 33C; further the pressure-fuel conversion factor $K_Q$ is read out from the ROM 33B, so as to compute the fundamental amount of the injected fuel $Q_B$ by means of the equation:

$$Q_B = K_Q \times K_A \times \eta v(Ne, PB_A) \times PB_A.$$

Similarly, at step 314, the necessary values are read out from the RAM 33C and ROM 33B to compute the fundamental amount $Q_B$ on the basis of the current pressure data PBin:

$$Q_B = K_Q \times K_A \times \eta v(Ne, PBin) \times PBin.$$

At the next step 315, the amount of fuel Q that is to be injected is calculated by adding the transient increase $Q_A$ to the fundamental amount $Q_B$:

$$Q = Q_A + Q_B.$$

Further, at step 316, the length of time PW during which the injector 20 is driven is calculated. Namely, the fuel-driving time conversion factor $K_{INJ}$ and dead time $T_D$ are read out from the ROM 33B to compute the driving time PW by the equation:

$$PW = Q \times K_{INJ} + T_D.$$

At step 317, the injector driving time PW is set in the timer 33D, which is thus put into operation for the time length PW; during the time PW in which the timer 33D is operating, the pulse-shaped injector driving signal Sj is applied to the injector 20 via the driving circuit 36, so that the amount of fuel corresponding to the amount Q is injected into the air inlet to the engine 11. At step 318, the current pressure data PBin obtained immediately before the current fuel injection is stored in the RAM 33C as the value of PBio which is to be used at steps 308 and 309 in determining the variation of the pressure data at the next fuel injection cycle.

Figure 8A:
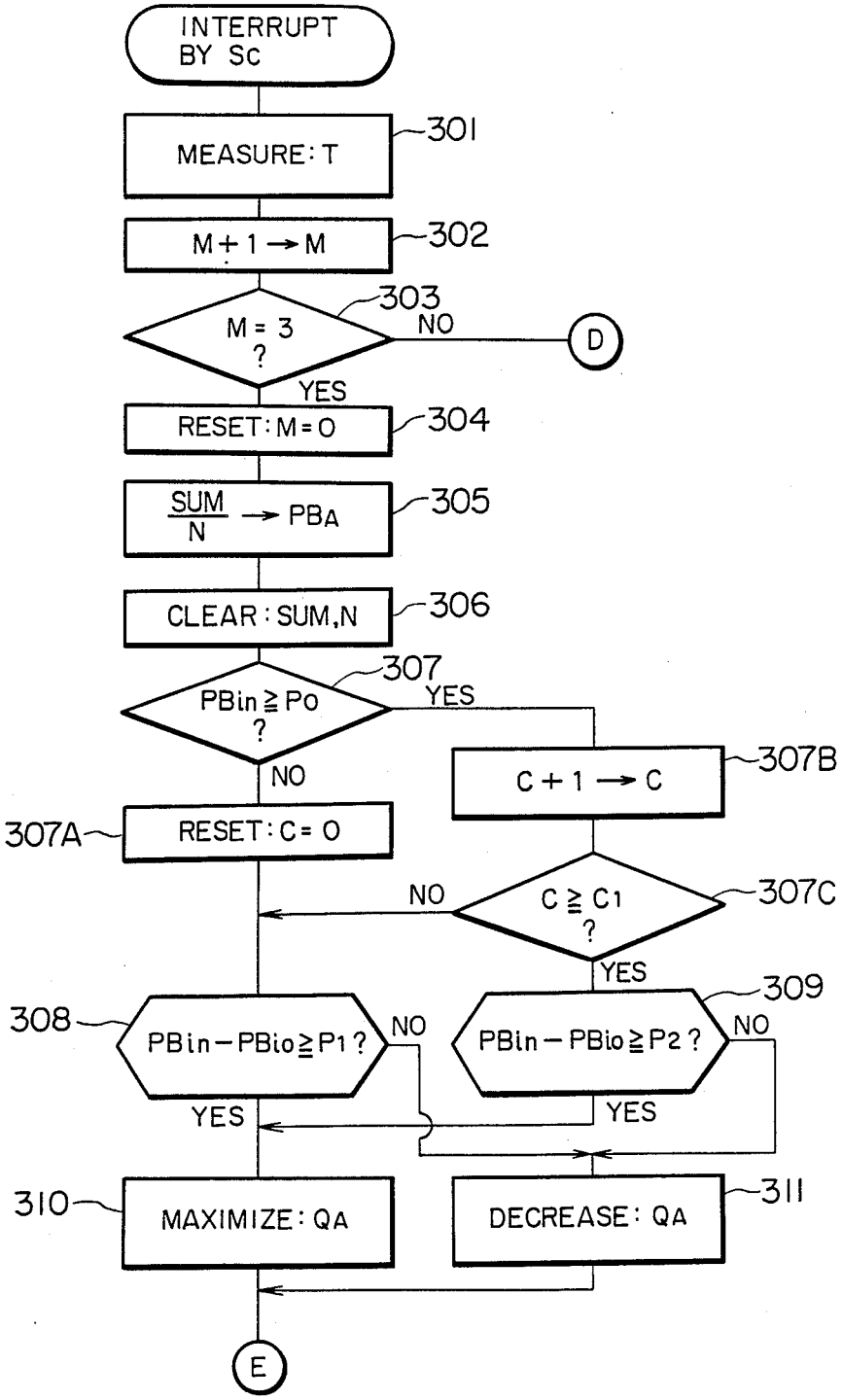
FIGS. 8A and 8B show a modified routine which may be substituted for the routine of FIG. 7.
Figure 8B:
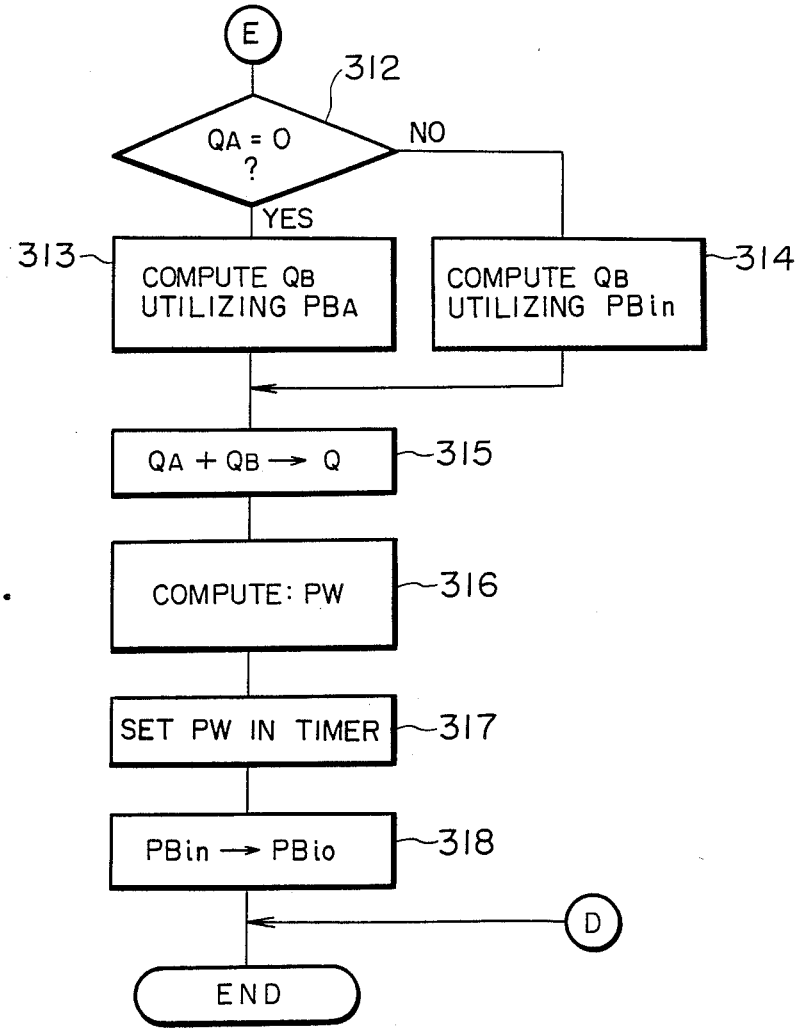

Referring next to FIG. 8 (*a*) and (*b*), let us describe a modified interrupt routine which may be substituted for the interrupt routine of FIG. 7 (*a*) and (*b*). The modified routine is characterized in the insertions of the steps 307A through 307C between the step 307 and the steps 308 and 309; the steps 301 through 307 and the steps 308 through 318 are identical to the corresponding steps in FIG. 7 which are designated by the same reference numerals.

In FIG. 8 (*a*), when the current pressure data PBin is judged at step 307 to be less than the predetermined reference level $P_0$, the program proceeds to step 307A; otherwise it proceeds to step 307B. At step 307A, the number C of every third occurence of the pulses of the crank angle signal Sc is reset to zero. On the other hand, at step 307B, unity (1) is added to the above number C to update the value thereof. At the next step 307C, this updated value obtained at step 307B is compared with a predetermined reference number $C_1$ stored in the ROM 33B; namely, judgement is made whether $$C \geqq C_1$$

holds or not. If the judgement at step 307C is in the negative (i.e. $C<C1$), the program proceeds to step 308; if in the affirmative, it proceeds to step 309. By the way, the updated number C obtained at step 307B is stored in the RAM 33C just before the program proceeds from step 307C to the next step 308 or 309.

Thus, the routine of FIG. 8 is characterized in the following feature: In the judgement (at steps 308 and 309) with respect to whether the transient increase $Q_A$ is to be maximized or decreased, the second (higher) threshold level $P_2$ is used only when the the relation: $PBin \geqq P_0$ holds for a length of time in which the number C of every third pulse of the crank angle signal Sc becomes equal to or exceeds the predetermined reference number $C_1$; otherwise, i.e., until the above number C becomes equal to $C_1$, the first (lower) threshold level $P_1$ is used even if the relation $PBin \geqq PO$ holds.

Figure 9:
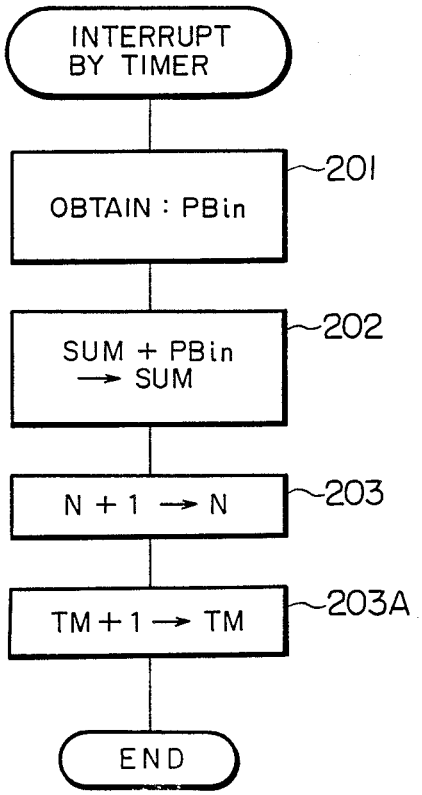
FIGS. 9, 10A, and 10B show another modified version of modified routines which may be substituted for the routines of FIGS. 6 and 7, respectively.
Figure 10A:
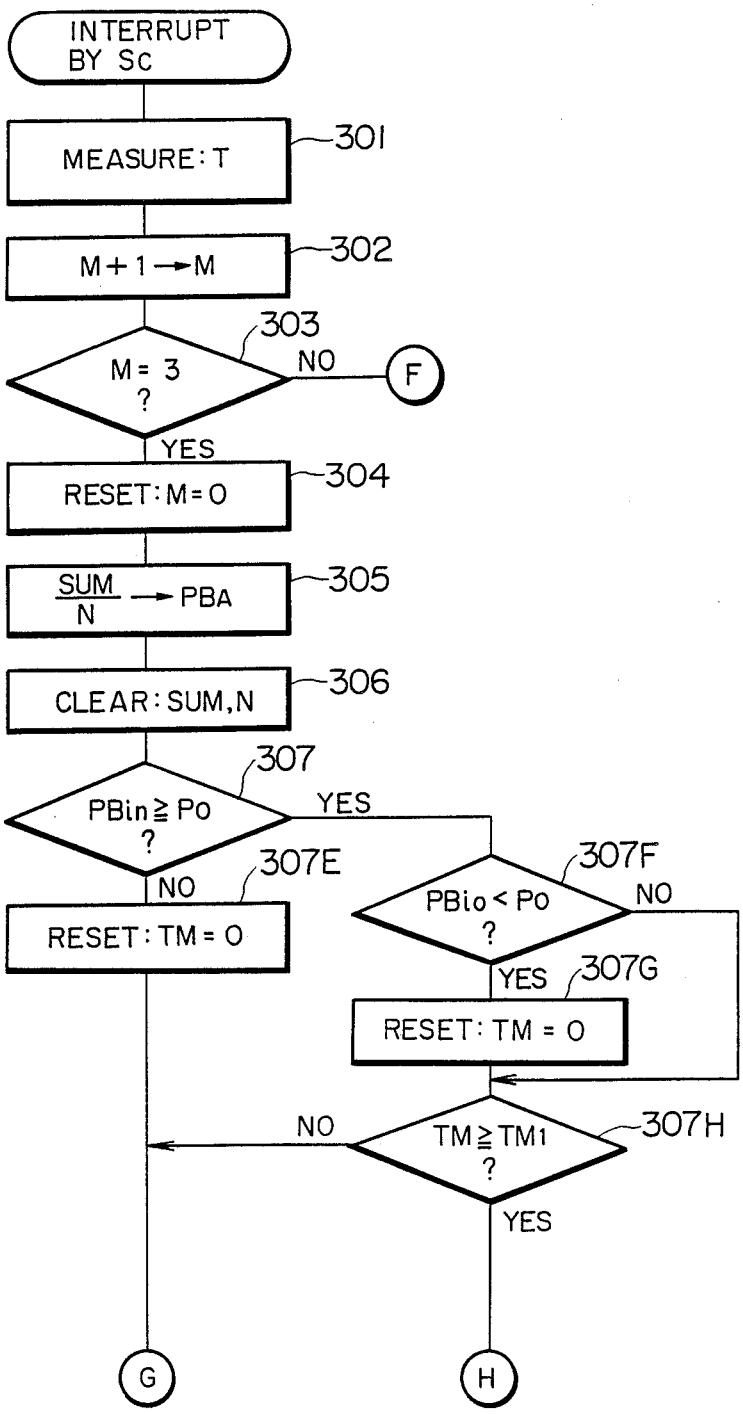
Figure 10B:
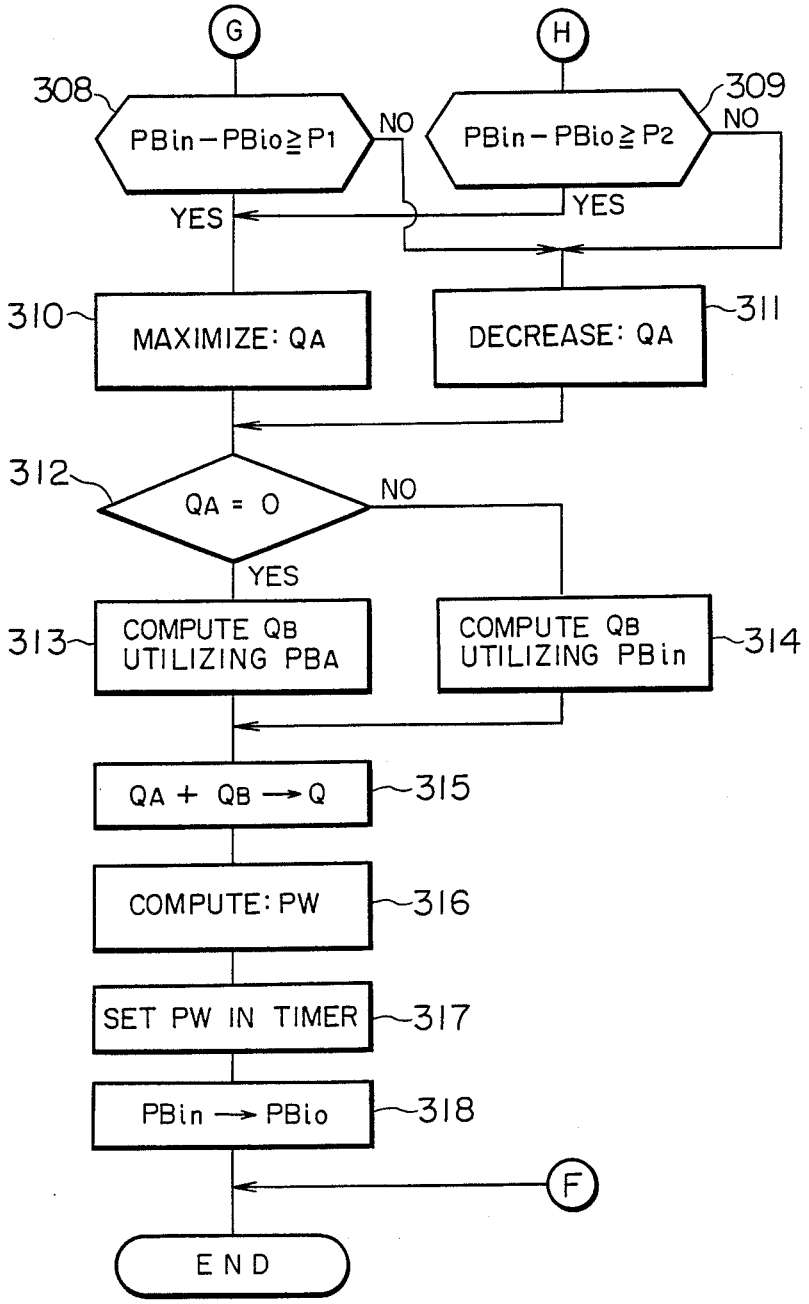

FIGS. 9 and 10 (*a*) and (*b*) show another version of modified interrupt routines which may be substituted for the routines of FIGS. 6 and 7 (*a*) and (*b*), respectively; in the routine of FIG. 9, which is otherwise identical to the routine of FIG. 6, a new step 203A is added; on the other hand, in the routine of FIG. 10 (*a*) and (*b*) which is otherwise identical to the routine of FIG. 7 (*a*) and (*b*), the steps 307E through 307H are inserted between the step 307 and the steps 308 and 309.

In each cycle of the routine of FIG. 9, at the final step 203A subsequent to the step 203, unity (1) is added to the timer value TM to obtain an updated value thereof, which is then stored in the RAM 33C. On the other hand, in the interrupt routine by the crank angle signal Sc shown in FIG. 10 (*a*) and (*b*), the program proceeds to step 307E when the pressure data PBin is judged at step 307 to be less than the reference level $P_0$ (i.e., $PBin<P_0$); it proceeds to step 307F when the pressure data PBin is judged at step 307 to be not less than the reference level $P_0$ (i.e., $PBin \geqq P_0$). At step 307E, the timer value TM is reset to zero, and the program proceeds to step 308. On the other hand, at step 307F, judgement is made whether the pressure data PBio obtained immediately before the previous fuel injection is less than the reference level $P_0$ or not. If the judgement at step 307F is in the affirmative, the timer value TM is reset to zero at the subsequent step 307G; if, on the other hand, the judgement at step 307F is in the negative (i.e. $PBio \geqq P_1$), the program proceeds directly to step 307H without resetting the timer value TM. At step 307H, the timer value TM is compared with a predetermined reference value $TM_1$ stored in the ROM 33; if it is judged that $TM \geqq TM_1$ holds, the program proceeds to step 309; otherwise (i.e. $TM<TM_1$), it proceeds to step 308. The steps 308 and 809 and the steps subsequent thereto are identical to those of the routine of FIG. 7. Incidentally, the step 307E is not absolutely necessary and may thus be omitted.

Thus, the interrupt routines of FIGS. 9 and 10 (*a*) and (*b*) are characterized by the following feature: the second (higher) threshold level $P_2$ is used in the determination of the transient increase $Q_A$ only when the length of time in which the relation: $PBin \geqq P_0$ holds becomes equal to or larger than the predetermined length of time corresponding to the reference value $TM_1$ of the timer value; otherwise, i.e., when the engine is under the low load condition (i.e. $PBin<P_0$) or the length of time in which the above relation has held good is less than the predetermined length of time, the first (lower) threshold level $P_1$ is used.

Figure 11:
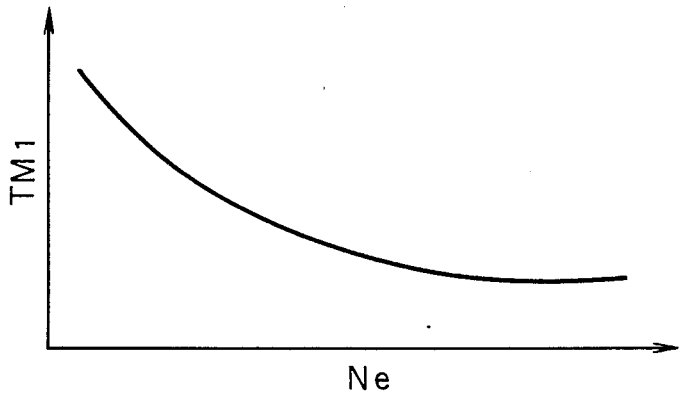
FIG. 11 is a graph showing a relation which may be utilized in the routine of FIG. 10.

Incidentally, in the routine of FIG. 9, the timer value TM is counted up at every step 203, and the value of TM is compared with a setting value $TM_1$ at step 307G in the routine of FIG. 10 (*a*) and (*b*); however, it will be easy for those skilled in the art to modify the routine in such a manner that the timer value TM may be counted down from the setting value $TM_1$. Further, the inversely porportional relationship between the number of rpm Ne of the engine and the setting value $TM_1$, as shown in FIG. 11, may be stored in the ROM 33B; in such case, the value of $TM_1$ corresponding to the number of rpm Ne calculated at step 102 of FIG. 5 is read out from the ROM 33B by the mapping, and the timer value TM is compared with the reference value $TM_1$ obtained in the above manner.

Figure 12:
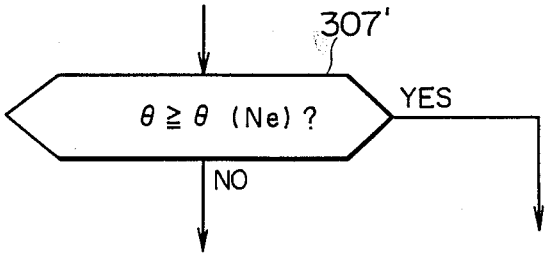
FIG. 12 shows a modified step for determining the load condition of the engine, which may be substituted for the corresponding step in the routines of FIGS. 7, 8, and 10.
Figure 13:
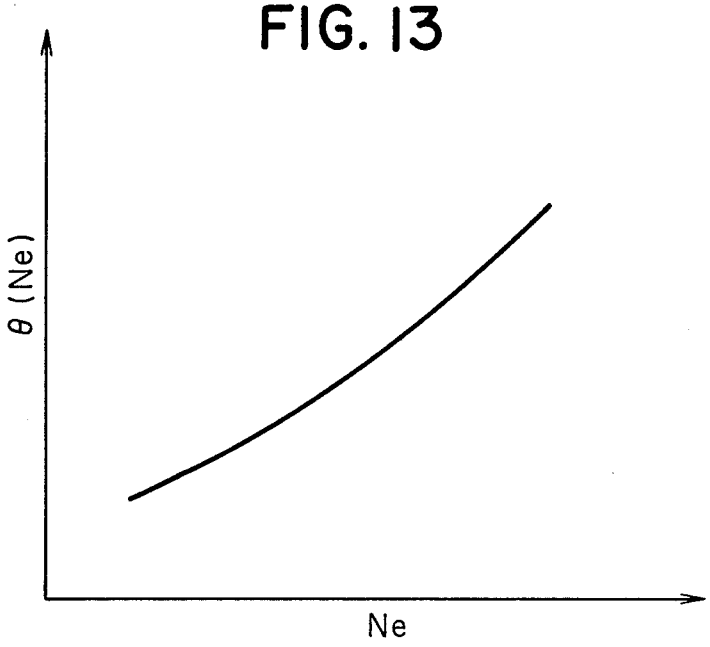
FIG. 13 is a graph showing a relation which may be utilized in the step shown in FIG. 12.

Further, at the load condition determining step 307 of FIGS. 7 (*a*), 8 (*a*), and 10 (*a*), the pressure data PBin is compared with a predetermined level $P_0$ to determine the load condition of the engine 11; this step 307 may be replaced by another load condition determining step 307' shown in FIG. 12. In the case of step 307', the opening degree $\theta$ of the throttle valve detected by the opening degree sensor 27 and converted into a corresponding digital signal by the A/D converter 35 is compared with the setting value of the throttle valve $\theta$ (Ne), which is read out from the ROM 33B, so as to determine the load condition; namely, if $\theta \geqq \theta$ (Ne), it is judged that the load condition is high; otherwise, it is judged that the load condition is low. The setting value $\theta$ (Ne) may be a predetermined constant; however, it may be increased proportionally with the increase of the number of rpm Ne, as shown in FIG. 13. The opening degree $\theta$ may be detected at step 106 in the main routine of FIG. 5, or at step 307' of FIG. 12 itself, or at a step which is newly inserted in the interrupting routine initiated by the timer.

In the above fuel injection device according to this invention, the adverse effects of the ripple contained in the pressure signal Sp are suppressed both by the averaging of the pressure data by the averaging means 6 and the filter 34 when, for example, the rpm of engine is near its maximum. Thus, by an appropriate selection of the filtering or attenuating characteristics of the analog filter 34 and the period $t_{A\ D}$ of the A/D conversion timing, the adverse effects of the ripples can be minimized.

While description has been made of the particular embodiments of this invention, it will be understood that many modifications may be made without departing from the spirit thereof; for example, the crank angle signal Sc may be replaced by an ignition pulse signal at the primary side of the ignition coil 22, which is generated at each predetermined crank angle. The appended claims are contemplated to cover any such modifications as fall within the true spirit and scope of this invention.

What is claimed is:

1. A fuel injection device for injecting a controlled amount of fuel into an air inlet passage to a cylinder of a spark ignition type internal combustion engine, said fuel injection device comprising:

pressure detector means for detecting a pressure within the air inlet passage to the cylinder of the internal combustion engine, said pressure detector means outputting a pressure data corresponding to the detected pressure;

pressure variation determining means, coupled to said pressure detector means, for determining a variation of the pressure data over a length of time;

load condition judgement means for determining a load condition of the internal combustion engine;

threshold level selecting means, coupled to said load condition judgement means, for selecting, in accordance with the load condition of the internal combustion engine determined by the load condition judgement means, a threshold level of the pressure variation determined by the pressure variation determining means;

comparator means for comparing said pressure variation determined by said pressure variation determining means, with said threshold level selected by said threshold level selecting means;

transient increase calculation means, coupled to said comparator means, for calculating a transient increase of an amount of fuel that is to be injected by the fuel injection device, in accordance with the result of the comparision effected by said comparator means;

averaging means for taking an average of a plurality of pressure data outputted from said pressure detector means over an interval of time;

pressure data selector means, coupled to said pressure detector means, averaging means, and said transient increase calculation means, for selecting, in accordance with the transient increase of the amount of fuel calculated by said transient increase calculation means, either the averaged pressure data determined by said averaging means or the pressure data currently outputted from said pressure detector means;

fundamental amount calculating means, coupled to said pressure data selecting means, for calculating a fundamental amount of fuel that is to be injected by the fuel injection device, wherein the calculation of the fundamental amount of injected fuel is based on a pressure value selected by said pressure data selector means;

adder means, coupled to said transient increase calculation means and fundamental amount calculation means, for adding said transient increase of the amount of fuel and the fundamental amount of fuel, thereby obtaining a total amount of fuel that is to be injected by the fuel injection device; and fuel injector means, coupled to said adder means, for injecting the fuel into the air inlet passage to the cylinder of the internal combustion engine, in a controlled amount equal to the total amount of fuel obtained by said adder means.

2. A fuel injection device as claimed in claim 1, wherein said load condition judgement means is coupled to an output of said pressure detector means and compares a current pressure data outputted from said pressure detector means with a predetermined reference level, to determine the load condition of the internal combustion engine.

3. A fuel injection device as claimed in claim 2, wherein said load condition judgement means judges: that the load condition requires that a higher threshold level be selected by said threshold level selecting means, only when said pressure data continues to be not less than said predetermined reference level for a predetermined length of time.

4. A fuel injection device as claimed in claim 1, wherein said pressure variation determining means determines the variation of the pressure data over each fuel injection period between two successive fuel injections effected by the fuel injection device.

5. A fuel injection device as claimed in claim 1, wherein said averaging means takes the average of the pressure data outputted from said pressure detector means over each fuel injection period between two successive fuel injections effected by the fuel injection device.

6. A fuel injection device as claimed in claim 1, wherein said transient increase calculation means maximizes the transient increase of the amount of fuel when, as a result of the comparison effected by the comparator means, said variation of the pressure data is not less than said threshold level selected by said threshold level selecting means; and decreases the transient increase of the amount of fuel when, as a result of the comparison effected by the comparator means, said variation of the pressure data is less than said threshold level.

7. A fuel injection device as claimed in claim 1, wherein said pressure data selector means selects the averaged pressure data when the transient increase of the amount of fuel calculated by said transient increase calculation means is equal to zero; and the current pressure data when the transient increase of the amount of fuel calculated by said transient increase calculation means is greater than zero.

8. A fuel injection device as claimed in claim 1, wherein said load condition judgement means determines a high and low condition of the load of the internal combustion engine, and said threshold level selecting means selects a first threshold level when the load condition determined by said load condition judgement means is low, and a second threshold level which is higher than said first level, when the load condition determined by said load condition judgement means is high.

9. A fuel injection device as claimed in claim 8, further comprising opening degree detector means for detecting an opening degree of a throttle valve of the internal combustion engine, wherein said load condition judgement means judges that the load condition is high when the opening degree of the throttle valve detected by said opening degree detector means is not less than a predetermined reference level; and that the load condition is low when the opening degree of the throttle valve detected by said opening degree detector means is less than said predetermined reference level.

10. A fuel injection device as claimed in claim 1, further comprising crank angle detector means for generating a crank angle signal comprising pulses that correspond to a predetermined angle of a crank shaft of the internal combustion engine, wherein said pressure variation determining means determines the variation of the pressure data over a predetermined length of time determined by said pulses of the crank angle signal.

11. A fuel injection device as claimed in claim 1, further comprising crank angle detector means for generating a crank angle signal comprising pulses that correspond to a predetermined angle of a crank shaft of the internal combustion engine, wherein said averaging means takes the average of the pressure data over a predetermined interval of time determined by said pulses of the crank angle signal.

* * * * *